US006571441B1

(12) United States Patent
Kobayashi et al.

(10) Patent No.: US 6,571,441 B1
(45) Date of Patent: Jun. 3, 2003

(54) NONWOVEN FABRIC MAKING APPARATUS

(75) Inventors: Toshio Kobayashi, Kagawa-ken (JP); Hideyuki Ishikawa, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 09/543,100

(22) Filed: Apr. 4, 2000

(30) Foreign Application Priority Data

Apr. 5, 1999 (JP) ..... 11-098006

(51) Int. Cl.[7] ..... D06B 1/02; D04H 1/46

(52) U.S. Cl. ..... 28/104

(58) Field of Search ..... 28/104, 105, 167, 28/106; 68/200, 205 R, 201; 239/548, 554, 556, 557, 560

(56) References Cited

U.S. PATENT DOCUMENTS

| | | | | |
|---|---|---|---|---|
| 3,635,625 A | | 1/1972 | Voss | |
| 4,069,563 A | * | 1/1978 | Contractor et al. | 28/105 |
| 5,235,733 A | * | 8/1993 | Willbanks et al. | 28/105 |
| 5,657,520 A | * | 8/1997 | Greenway et al. | 28/104 |
| 5,806,155 A | * | 9/1998 | Malaney et al. | 28/104 |
| 6,253,429 B1 | * | 7/2001 | Zolin | 28/104 |

FOREIGN PATENT DOCUMENTS

| | | | |
|---|---|---|---|
| CH | 534 241 | | 2/1973 |
| JP | 06-184895 | * | 7/1994 |
| JP | 6-207360 | | 7/1994 |
| WO | 99/29951 A2 A3 | | 6/1999 |

OTHER PUBLICATIONS (1) English Language Abstract of JP 06 184895.
(2) English Language Abstract of JP 09 256254.
(3) European Search Report and Annex.

* cited by examiner

*Primary Examiner*—Amy B. Vanatta
(74) *Attorney, Agent, or Firm*—Lowe Hauptman Gilman & Berner, LLP

(57) ABSTRACT

A nonwoven fabric making apparatus adapted to continuously feed a fibrous web in one direction, to eject streams of high pressure fluid from a plurality of nozzles against at least one surface of the web, thereby to entangle component fibers of the web and to obtain a predetermined nonwoven fabric. On the assumption that a Y-axis extends in a direction along which the web travels and an X-axis extends to intersect the Y-axis at right angles, the nozzles are arranged at predetermined intervals to define a straightly extending a first nozzle array R1 which is declined at a predetermined angle with respect to the Y-axis. The nonwoven fabric obtained has no impact traces by ejection of the streams of high pressure.

3 Claims, 6 Drawing Sheets

NONWOVEN FABRIC MAKING APPARATUS

BACKGROUND OF THE INVENTION

This invention relates to a nonwoven fabric making apparatus particularly to make nonwoven fabrics.

There has already been developed a nonwoven fabric making apparatus particularly to make nonwoven fabrics by continuously feeding a fibrous web on a conveyor belt moving at a predetermined velocity, ejecting streams of high pressure fluid from a plurality of nozzles against the upper surface of the web, and thereby entangling component fibers of the web together to form nonwoven fabrics.

Japanese Patent Application Disclosure No. 1994-207360 describes a nonwoven fabric making apparatus comprising a nozzle head adapted to eject streams of high pressure fluid against a fibrous web travelling in a given direction. The nozzle head is supported by a pair of oscillating bearings so that the nozzle head may be movable back and forth in its axial direction. The nozzle head may be reciprocated at uneven amplitudes transversely of the direction in which the web travels in the course of ejecting the streams of high pressure fluid.

The Japanese Patent Application Disclosure No. 1994-207360 intends to alleviate the formation of impact traces on the fiber entangled sheet.

While the Japanese Patent Application Disclosure No. 1994-207360 intends to solve this problem of impact traces by unevenly oscillating the nozzle head, a pattern is still formed by the oscillation at the uneven amplitude occurring transversely of the sheet. Consequently, the formation of bellows-like impact traces is inevitable.

Oscillation of the nozzle head at a relatively high velocity would make it impossible to focus the stream of high pressure fluid to desired spots on the web and thereby to entangle component fibers closely together.

SUMMARY OF THE INVENTION

It is an object of this invention to provide a nonwoven fabric making apparatus enabling component fibers of a web to be reliably entangled without any impact traces by streams of high pressure fluid thereon.

According to this invention, there is provided a nonwoven fabric making apparatus having a Y-axis and an X-axis intersecting the Y-axis, the apparatus comprising a plurality of nozzles adapted to eject streams of high pressure fluid against at least one surface of a fibrous web continuously traveling in a direction of the Y-axis, to entangle component fibers of the web, the nozzles being arranged at predetermined intervals in a direction of the x-axis to form a straightly extending first nozzle array declined at a predetermined angle with respect to the Y-axis.

According to one preferred embodiment of this invention, the respective nozzles of the first nozzle array are arranged at regular intervals in the direction of the X-axis and a plurality of straight lines extending parallel to the Y-axis to connect centers of corresponding nozzles in the respective nozzle arrays in alignment are successively spaced one from another by a distance P given by $$P = A_1 \sin \alpha_1$$

in which $A_1$: a length of the segment extending between centers of a pair of adjacent nozzles, and $\alpha_1$: a declination angle of the first nozzle array with respect to the Y-axis, and wherein the distance P is in a range of 0.1~0.25 mm.

According to another preferred embodiment of this invention, between the each pair of adjacent nozzles in the first nozzle array, a predetermined number (n) of nozzles are arranged at predetermined intervals in said directions of the Y-and X-axes so that the predetermined number (n) of nozzles define second~nth nozzle arrays extending parallel to the first nozzle array in the direction of the X-axis.

According to still another embodiment of this invention, the second~nth nozzle arrays are successively spaced from the first nozzle array and one from another and the predetermined number (n) of nozzles defining the second ~nth nozzle arrays lie at positions bisecting a length between each pair of adjacent nozzles in the first nozzle array, wherein a declination angle $\alpha_2$ of the first~nth nozzle arrays with respect to the Y-axis is given by $$\alpha_2 = \tan^{-1} \frac{B(n-1)}{2A_2(n-1)/n} = \tan^{-1} \frac{nB}{2A_2}$$

in which $\alpha_2$: declination angle of the nozzle arrays with respect to the Y-axis, $A_2$: length of a segment connecting centers of each pair of adjacent nozzles in the first nozzle array, B: distance between each pair of adjacent nozzle arrays in the direction of the Y-axis, and n: the number of nozzle arrays arranged in the direction of the Y-axis, and wherein a distance P between each pair of adjacent the straight lines extending in parallel to the Y-axis to connect the centers of the corresponding nozzles in the respective nozzle arrays in alignment is given by $$P = C\sin\alpha_2 = \frac{A_2}{n}\sin\alpha_2$$

in which

C: distance between each pair of adjacent nozzle arrays in the direction of the X-axis, and wherein the distance P is in the range of 0.1~0.25 mm. by that the nozzles are arranged at desired intervals in the direction of the X-axis to form a straightly extending first nozzle array declined at a predetermined angle with respect to the Y-axis.

DETAILED DESCRIPTION OF THE PREFERRED EMBODIMENTS

Details of a nonwoven fabric making apparatus according to this invention will be more fully understood from the description given hereunder with reference to the accompanying drawings.

Figure 1:
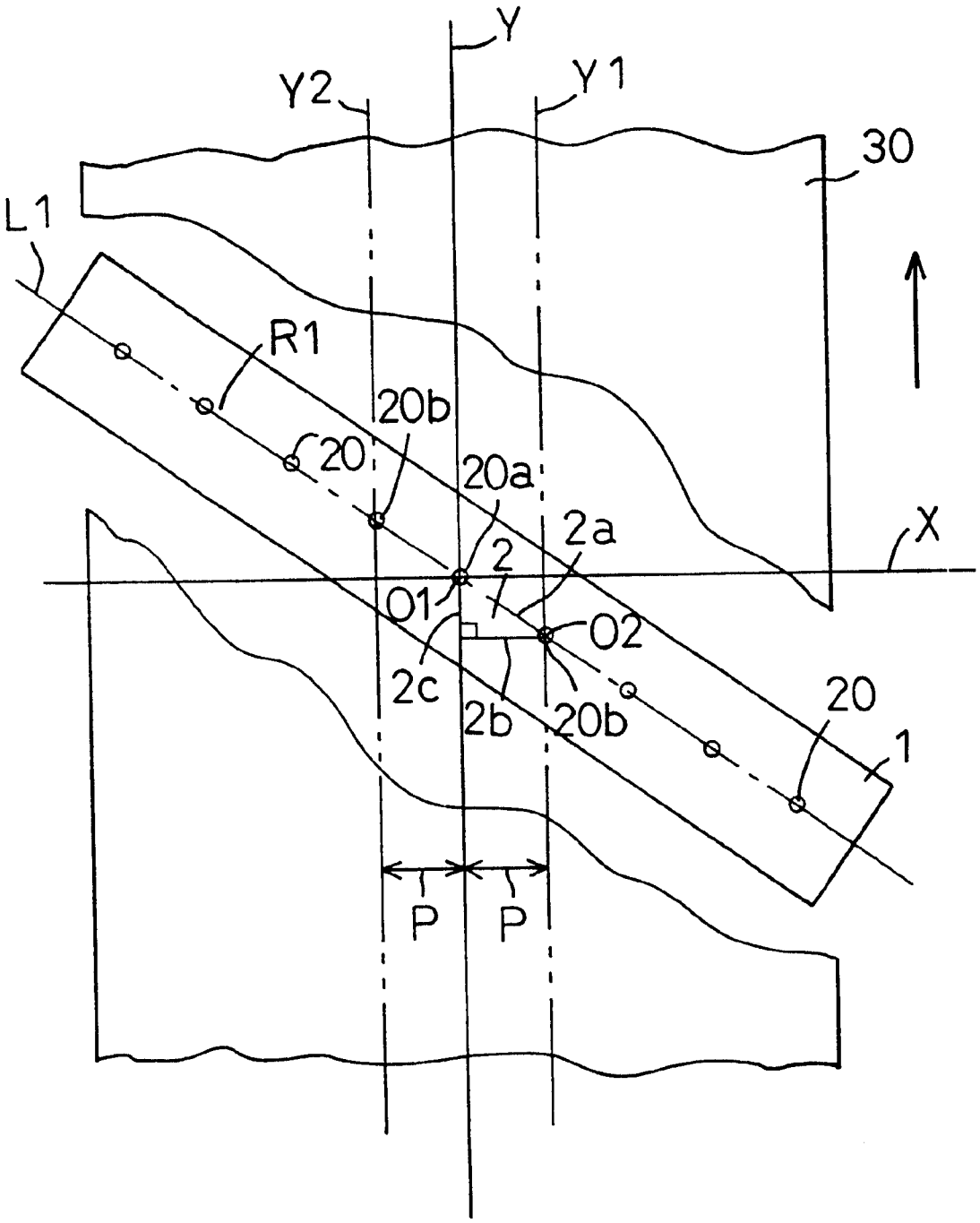
FIG. 1 is a plan view showing one embodiment of the support member as an important part of a nonwoven fabric making apparatus according to this invention.

FIG. 1 is a plan view showing a nozzle support member 1 making an important part of a nonwoven fabric making apparatus with a portion of a web 30 lying on the support member 1 being cutaway. While an entire construction is not illustrated, the apparatus has the support member 1 formed with a plurality of nozzles 20. High pressure fluid is ejected through fine orifices (not shown) of the respective nozzles 20 against at least one surface of the web 30 so that component fibers of the web 30 may be entangled to form a predetermined nonwoven fabric. Details of a technique to entangle the component fibers by ejection of high pressure fluid will be apparent from various documents such as the Japanese Patent Application Disclosure No. 1994-207360.

Referring to FIG. 1, a Y-axis extending in a direction as indicated by an arrow along which the web 30 travels and an X-axis intersecting the Y-axis at right angles, i.e., extending transversely of the web 30. These Y-axis and X-axis form coordinates. The web 30 is continuously fed in the direction of the arrow parallel to the Y-axis.

The support member 1 is formed with a first nozzle array R1 comprising a plurality of nozzles 20 arranged at regular intervals transversely (in the direction of the X-axis) of the support member 1. Centers of the respective nozzles 20 constituting the first nozzle array R1 lie on a single dotted chain line L1 straightly extending transversely of the support member 1. The center O1 of the nozzle 20*a* lying in the middle of the first nozzle array R1 corresponds to the origin of the coordinates. The support member 1 is fixedly mounted on the apparatus with the first nozzle array R1 declined with respect to both the Y-axis and the X-axis.

As viewed in FIG. 1, the first nozzle array R1 can be divided in two groups, i.e., the group of the nozzles 20 lying on the left hand with respect to the middle nozzle 20*a* and the group of the nozzles 20 lying on the right hand with respect to the middle nozzle 20*a*. The left hand group of the nozzles 20 lies in the second quadrant and the right hand group of the nozzles 20 lies the fourth quadrant. In the coordinates, straight lines Y1, Y2 indicated by two dotted chain lines, respectively, extend parallel to the Y-axis and the respective nozzles 20*b* adjacent the middle nozzle 20*a* lie on these straight lines Y1, Y2.

In the fourth quadrant of the coordinates, a right-angled triangle 2 is represented. This right-angled triangle 2 is defined by: an oblique line 2*a* connecting the centers O1, O2 of the nozzle 20*a* lying on the origin and the nozzle 20*b* adjacent this nozzle 20*a*; a horizontal line 2*b* connecting the center O2 of said nozzle 20*b* to the Y-axis and extending in parallel to the X-axis; and a perpendicular line 2*c* extending on the Y-axis from the center O1 of the nozzle 20*a* to said horizontal line 2*b*.

Figure 2:
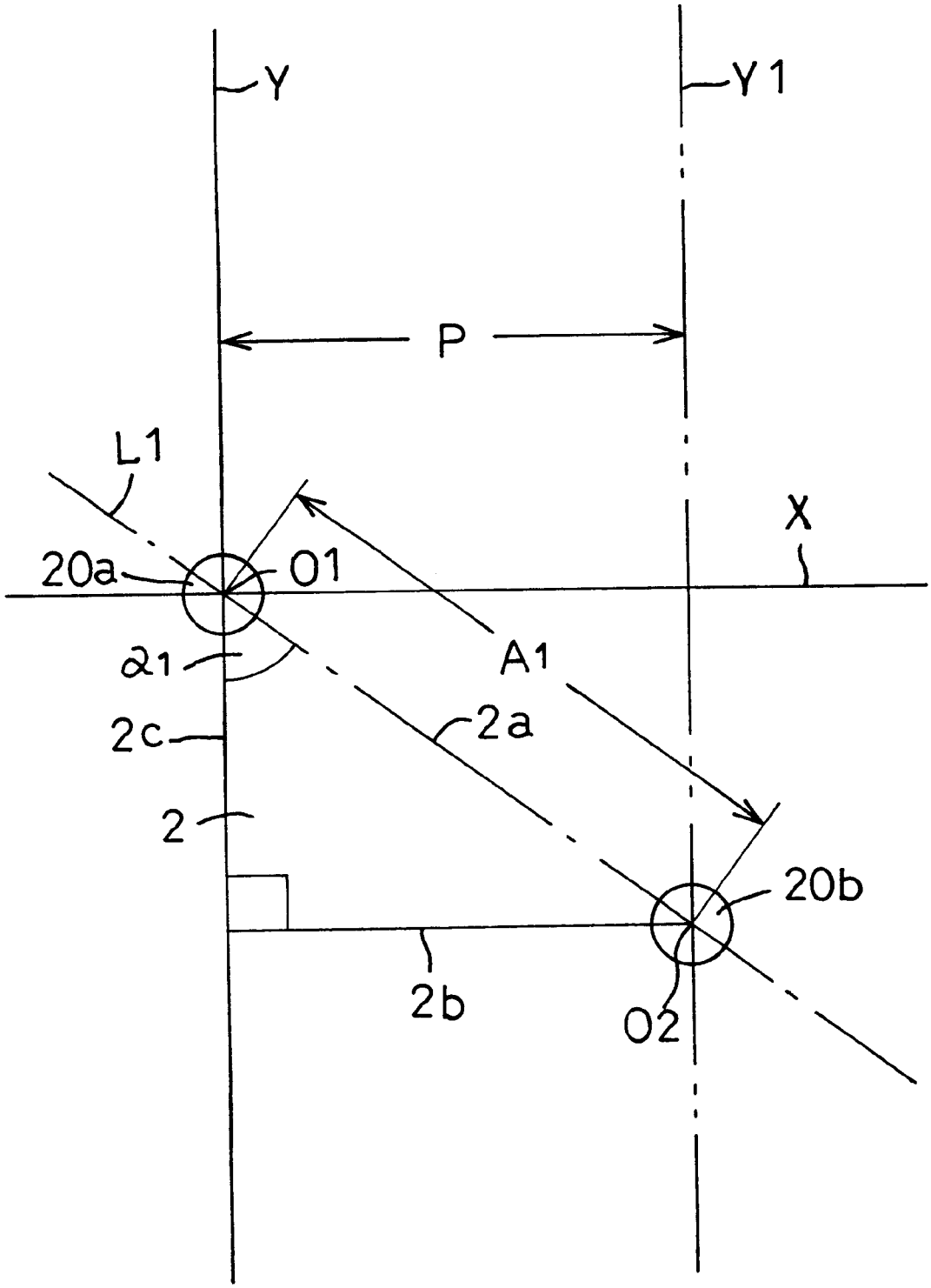
FIG. 2 is a scale-enlarged plan view of a right-angled triangle represented on coordinates of FIG. 1.

FIG. 2 is a scale-enlarged plan view of a right-angled triangle 2 represented on the coordinates of FIG. 1. The first nozzle array R1 is declined with respect to the Y-axis at an angle $\alpha_1$ included between the oblique line 2*a* and perpendicular line 2*c*. A distance P between the Y-axis and the straight line Y1 projected on the X-axis (i.e., a length of the horizontal line 2*b* as one side of the triangle 2) is given by the following equation:

$$P=A \sin \alpha_1 \quad (1)$$

wherein $A_1$ represents a length of the oblique line 2*a* and $\alpha_1$ represents an angle at which the first nozzle array R1 is declined with respect to the Y-axis.

For example, on the assumption of $\alpha_1=10°$ and A=1 mm, P=1 sin 10°=0.174 (mm). Value P is preferably in a range of 0.1~0.25 mm. P's value less than 0.1 mm would cause all the nozzles 20 to overlap one upon another. The value P larger than 0.25 mm would result in a nonwoven fabric having impact traces left thereon.

When it is desired to use any existing support member, an appropriate angle $\alpha_1$ to define the value P in the range may be obtained on the basis of the equation 1 since the length $A_1$ is predetermined. When the angle $\alpha_1$ is predetermined, on the other hand, an appropriate length $A_1$ to define the value P in the range may be obtained on the basis of the equation 1.

At the respective high pressure fluid impact spots, component fibers of the web 30 are moved in opposite sides of the respective spots in the direction of the X-axis. The component fibers thus forcibly moved are closely gathers between each pair of adjacent spots corresponding to each pair of adjacent nozzles 20*a* and 20*b* to form high density regions. These high density regions appear as stripe-like impact traces on the finished nonwoven fabric. The angle $\alpha_1$ of the first nozzle array R1 with respect to the Y-axis may be selectively reduced to correspondingly reduce the value P and thereby to adjustably close respective streams of fluid ejected against the web 30.

So far as the value P is in the foresaid range, fluid ejection from the nozzle 20*a* may be slightly delayed with respect to the adjacent nozzles 20*b* to hit the spots at which the component fibers have been closely gathered. In this manner, the component fibers once closely gathered can be moved back and undesirable impact traces can be erased. Parallel to the Y-axis, the respective streams of high pressure fluid continuously hit the corresponding regions of the web 30 and thereby ensure the component fibers to be sufficiently entangled together.

Figure 3:
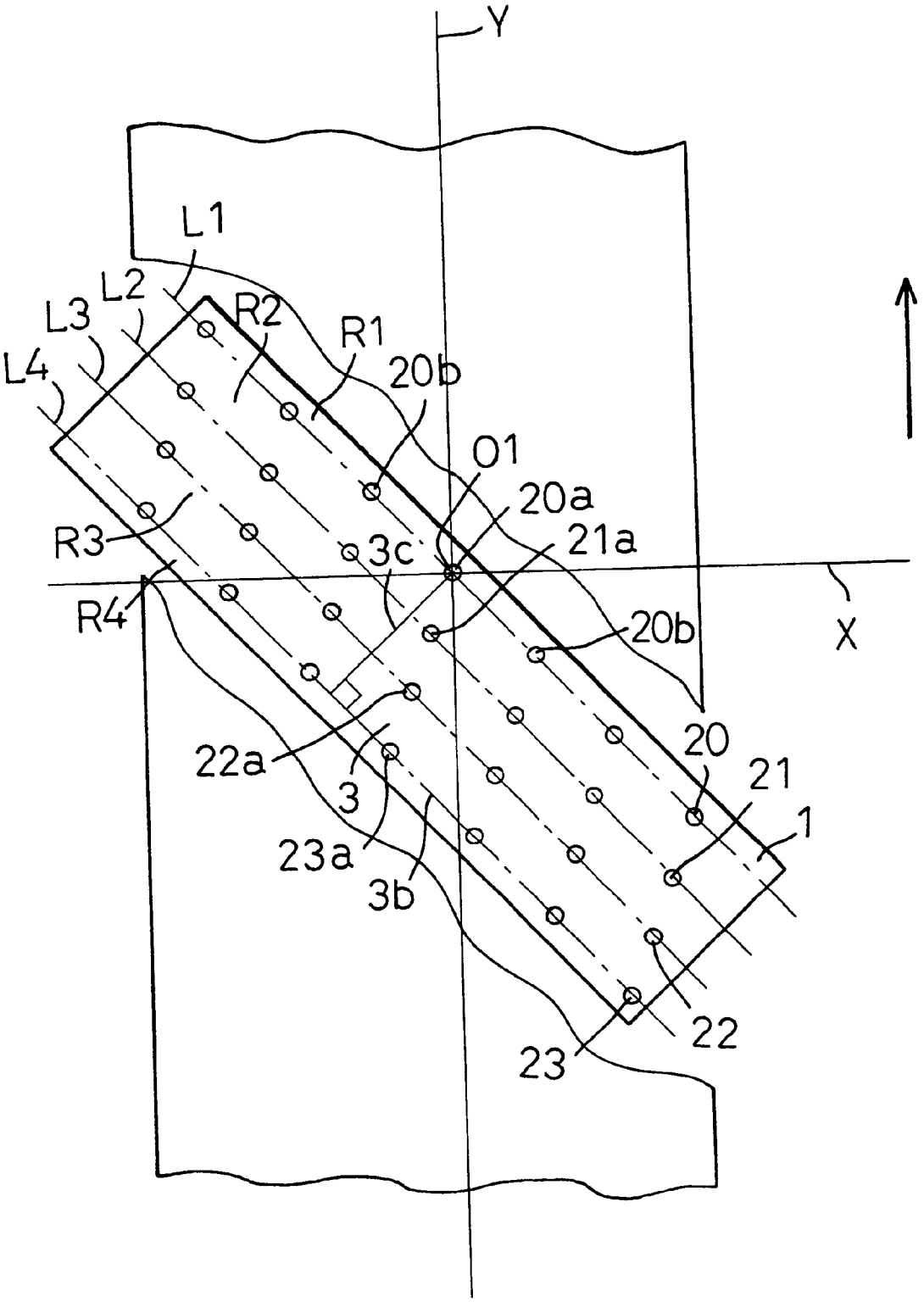
FIG. 3 is a plan view showing another embodiment of a support member.

FIG. 3 is a plan view the support member 1 realized in a manner different from that shown by FIG. 1. This support member 1 is formed with, in addition to the first nozzle array R1, second~fourth nozzle arrays R2, R3, R4 arranged transversely of the support member 1 successively parallel to said first nozzle array R1. The support member 1 is fixedly mounted on the apparatus with these first~fourth nozzle arrays R1, R2, R3, R4 declined at a predetermined angle with respect to the Y-axis.

Referring to FIG. 3, centers of the respective nozzles 20, 21, 22, 23 constituting the first~fourth nozzle arrays R1, R2, R3, R4 lie on single dotted chain lines L1, L2, L3, L4 straightly extending transversely of the support member 1. The center O1 of the nozzle 20*a* lying in the middle of the first nozzle array R1 corresponds to the origin of the coordinates.

Portions of the first~fourth nozzle arrays R1, R2, R3, R4, i.e., 20, 21, 22, 23 arranged on the left hand with respect to the Y-axis lie in the second and third quadrants and portions thereof arranged on the right hand with respect to the Y-axis lie in the third quadrant. In the third quadrant of the coordinates, a right-angled triangle 3 is represented. This right-angled triangle 3 is defined by: an oblique line 3*a* extending along the Y-axis from the centers O1 of the nozzle 20*a* lying on the origin; a horizontal line 3*b* extending along the single dotted chain line L4 of the fourth nozzle array R4; and a perpendicular line 3*c* extending from the center O1 of the nozzle 20*a* to the horizontal line 3*b*.

Figure 4:
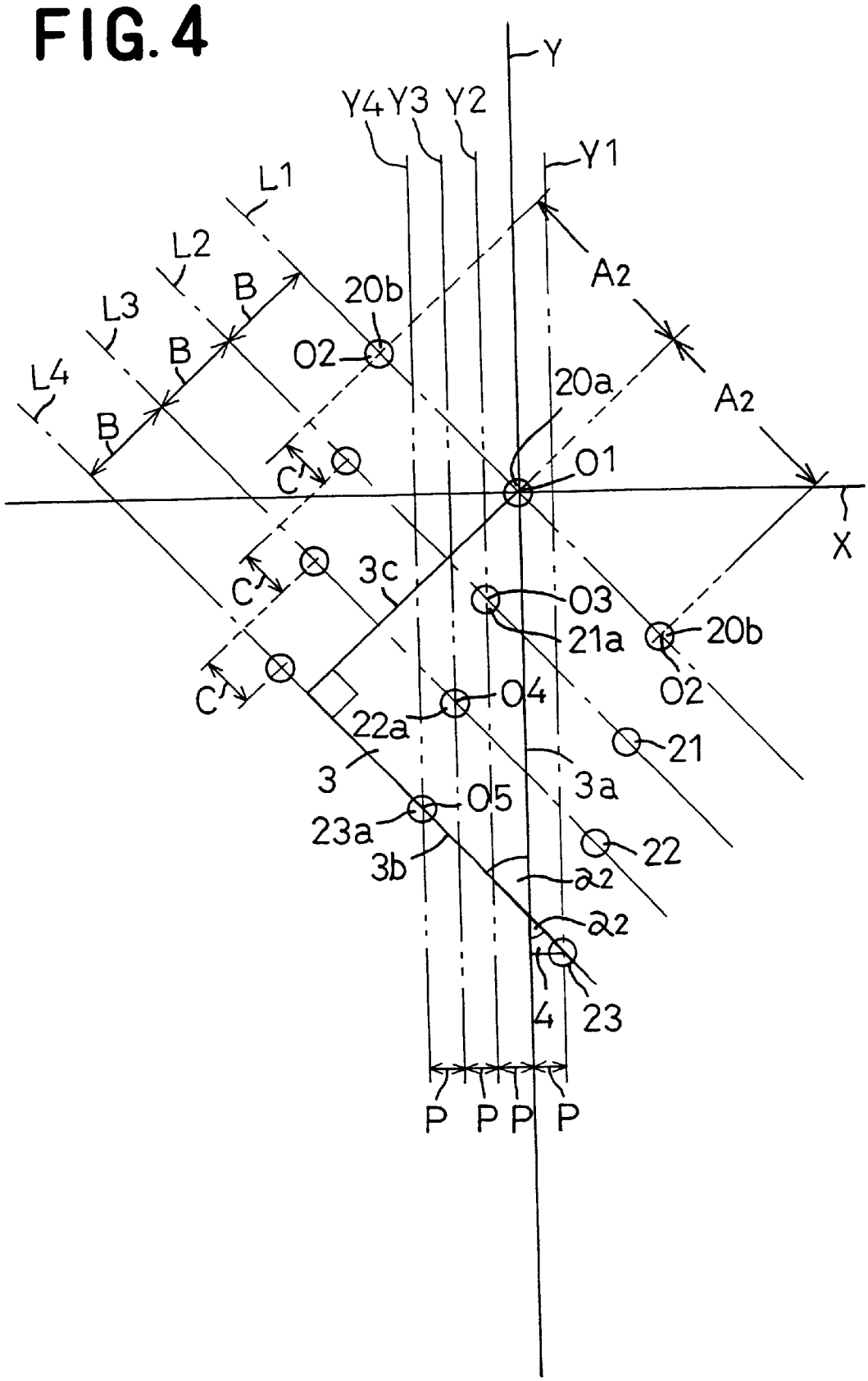
FIG. 4 is a scale-enlarged plan view of a right-angled triangle represented on coordinates of FIG. 3.

FIG. 4 is a scale-enlarged plan view showing the right-angled triangle 3 represented on the coordinates of FIG. 3. The first~fourth nozzle arrays R1, R2, R3, R4 are arranged at regular distances of B in the direction of the Y-axis and the nozzles 20*a*, 20*b* of the first nozzle array R1 are spaced one from another by a length $A_2$ transversely of the support member 1 (i.e., in the direction of the X-axis).

Three nozzles 21*a*, 22*a*, 23*a* of the second~fourth nozzle arrays R2, R3, R4 arranged in the direction of the Y-axis are successively spaced one from another by a length C transversely of the support member 1 so as to bisect the length $A_2$ between each pair of adjacent nozzles 20*a*, 20*b* of the first nozzle array R1. Accordingly, the nozzle 21*a* and the nozzle 21 of the second nozzle array R2, the nozzle 22*a* and the nozzle 22 of the third nozzle array R3, and the nozzle 23*a* and the nozzle 23 of the fourth nozzle array R4 are respectively spaced one from another by the length $A_2$ transversely of the support member 1.

In the coordinates of FIG. 4, two dotted chain lines Y1, Y2, Y3, Y4 straightly extend parallel to the Y-axis and centers O1, O3, O4, O5 of the nozzles 20*a*, 21*a*, 22*a*, 23*a* in the respective nozzle arrays R1, R2, R3, R4 lie on these lines Y1, Y2, Y3, Y4. A right-angled triangle 4 similar to the triangle 3 is represented in the fourth quadrant of the coordinates.

The centers O1, O3, O4, O5 of the nozzles 20*a*, 21*a*, 22*a*, 23*a* are successively spaced one from another by a distance P between the Y-axis and the straight line Y1 projected on the X-axis or a distance P projected on the X-axis by which the respective straight lines Y2, Y3, Y4 are successively spaced one from another. The distance P is smaller than the length C.

An angle $\alpha_2$ of the triangle 3 at which the nozzle array decline with respect to the Y-axis is given by the following equation:

$$\alpha_2 = \tan^{-1}\frac{B(n-1)}{2A_2(n-1)/n} = \tan^{-1}\frac{nB}{2A_2} \tag{2}$$

wherein $A_2$ represents a length of a segment extending between the centers O1, O2 of each pair of adjacent nozzles 20*a*, 20*b* in the first nozzle array R1, B represents a length by which the respective nozzle arrays R1, R2, R3, R4 are successively spaced one from another in the direction of the Y-axis, and n represents the number of the nozzles 20, 21, 22, 23 arranged in the direction of the Y-axis.

For example, $A_2$=1 mm, B=0.7 mm and n=4 may be substituted for this equation to obtain $\alpha_2=\tan^{-1} 1.4=54.5°$.

Figure 5:
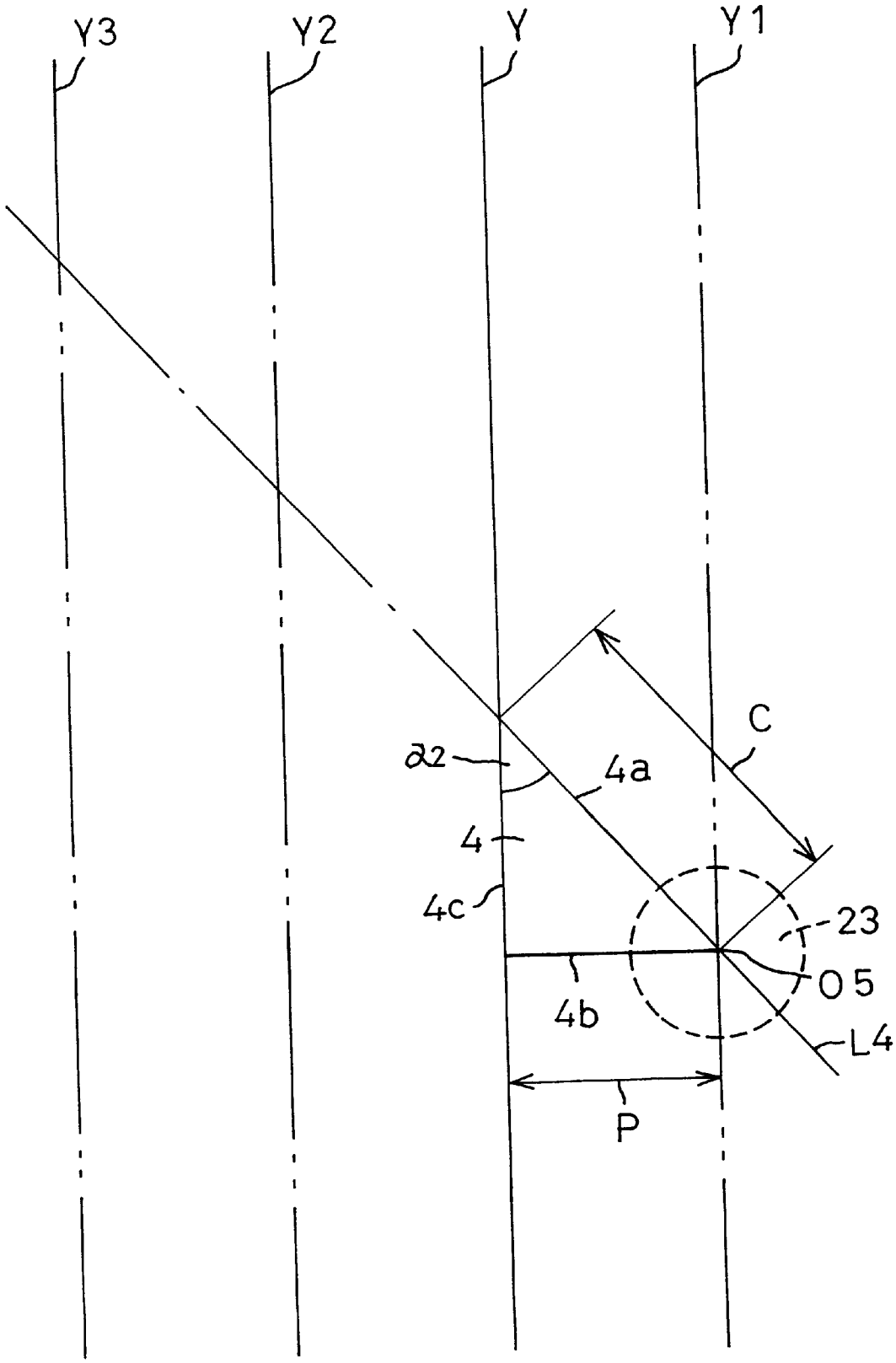
FIG. 5 is a scale-enlarged plan view showing a right-angled triangle similar to the triangle represented in FIG. 4.

FIG. 5 is a scale-enlarged plan view showing a right-angled triangle similar to the triangle 3 represented in FIG. 4. This triangle 4 is defined by an oblique line 4*a* extending along the single dotted chain line L4 of the fourth nozzle array R4, a perpendicular line 4*c* along the Y-axis and a horizontal line 4*b* extending parallel to the X-axis from the center O5 of the nozzle 23 to the Y-axis. As will be apparent from FIG. 4, the triangle 4 is similar to the triangle 3 and therefore the angle $\alpha_2$ of the triangle 4 is identical to the angle $\alpha_2$ of the triangle 3.

A distance P between the Y-axis and the straight line Y1 measured as projected on the X-axis (i.e., the length of the horizontal line 4*b* in the triangle 4) is given by the following equation:

$$P = C\sin\alpha_2 = \frac{A_2}{n}\sin\alpha_2 \tag{3}$$

wherein C represents a length by which the respective nozzle arrays R1, R2, R3, R4 are successively spaced one from another transversely of the support member 1.

For example, $\alpha_2$=54.5° and C=0.25 may be substituted for this equation to obtain P=0.25 sin 54.5=0.2 mm in the range of 0.1~0.25 mm.

For the support member 1 formed with a plurality of nozzle arrays, a declination of the respective nozzle arrays with respect to the Y-axis can be determined according to the equation (2) so far as the remaining factors are given. The remaining factors are the length $A_2$ of the segment extending between the centers O1, O2 of each pair of adjacent nozzles 20*a*, 20*b* in the first nozzle array R1, the length B by which the respective nozzle arrays are successively spaced one from another, and the number of the nozzles arranged in the direction of the Y-axis. A distance P between each pair of adjacent two dotted chain lines measured as projected on the X-axis can be determined according to the equation (3). To set up the condition of nozzle arrangement on the support member 1 so that the length P may be given in the foresaid range, three of those values $\alpha_2$, $A_2$, B, n may be appropriately chosen to determine the remaining one value according to the equations 2 and 3.

It is not essential to arrange the nozzles on the support member 1 at regular intervals and it is also possible to arrange them at irregular intervals so far as the value P is in the range of 0.1~0.25 mm. The number of the nozzle arrays also is not limited to the number as described and illustrated. For example, two, three, four more nozzle arrays may formed on the support member 1.

EXAMPLE

Figure 6:
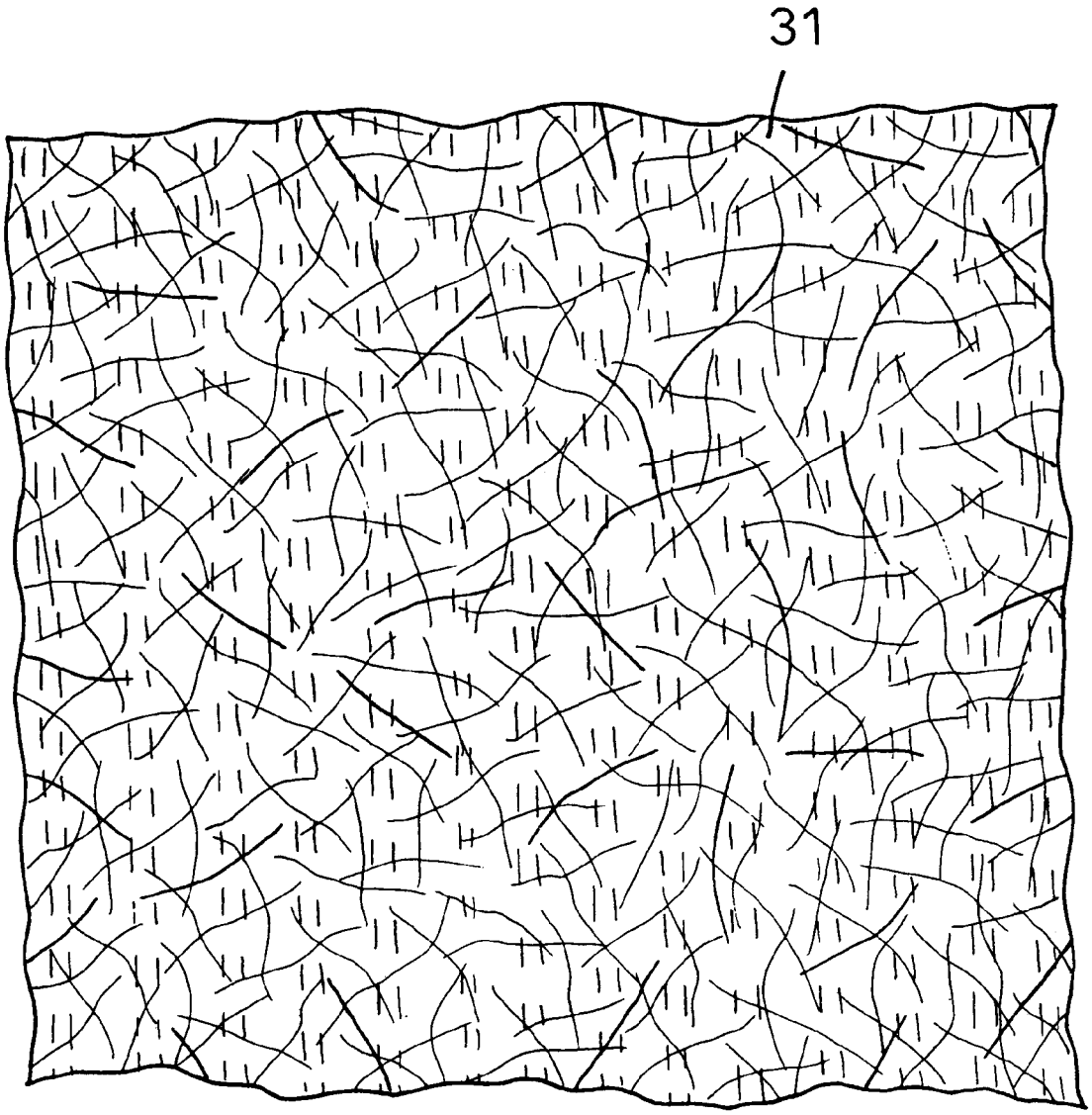
FIG. 6 is a fragmentary plan view of a nonwoven fabric using the support shown by FIG. 3.

FIG. 6 is a fragmentary plan view of a nonwoven fabric made by using the apparatus provided with the support member 1 shown by FIG. 3. Continuous fiber of polypropylene having a basis weight of 20 g/m$^2$ was used as the web 30 constituting the nonwoven fabric. The apparatus was operated under a condition that the web 30 should travel at a velocity of 40 m/sec and fluid should be ejected only once against the upper surface of the web 30 under a pressure of 100 kg/cm$^2$. The support member 1 was formed with first~fourth nozzle arrays of which the respective nozzles were arranged with $A_2$=1 mm and B=0.7 mm. The declination of the nozzle arrays with respect to the Y-axis was 54.5° according to the equation (2) and the value P was 0.2 mm according to the equation (3). Impact traces by the high pressure fluid were practically unnoticeable on the resultant nonwoven fabric.

The nonwoven fabric making apparatus according to this invention enables the component fibers of the web to be sufficiently entangled together without leaving the impact traces by the high pressure fluid on the nonwoven fabric. It is necessary for the apparatus according to this invention merely to decline the support member formed with the nozzle arrays with respect to the direction in which the web travels. It is unnecessary for the apparatus according to this invention to rearrange the nozzles and/or to increase the number of the nozzle arrays. Accordingly, the existing apparatus may be modified to obtain the apparatus equivalent to the apparatus of this invention.

What is claimed is:

1. A nonwoven fabric making apparatus having X and Y axes perpendicular to each other, said apparatus comprising a plurality of nozzles adapted to eject streams of high pressure fluid against at least one surface of a fibrous web continuously traveling in a direction of said Y-axis to entangle component fibers of said web, said nozzles being arranged to form at least a first nozzle array inclined at a predetermined angle with respect to said Y-axis, wherein projections of centers of adjacent nozzles of said first nozzle array onto said X-axis are spaced one from another by a projected distance P given by $$P=A_1 \sin \alpha$$

where $A_1$ is an actual distance between said centers of said adjacent nozzles, and $\alpha$ is a declination angle of the first nozzle array with respect to said Y-axis, and wherein said distance P is in a range of from about 0.1 to about 0.25 mm.

2. A nonwoven fabric making apparatus having X and Y axes perpendicular to each other, said apparatus comprising a plurality of nozzles adapted to eject streams of high pressure fluid against at least one surface of a fibrous web continuously traveling in a direction of said Y-axis to entangle component fibers of said web, said nozzles being arranged to form at least a first nozzle array inclined at a predetermined angle with respect to said Y-axis, said apparatus further comprising between each pair of adjacent nozzles of said first nozzle array, a predetermined number (n−1) of nozzles arranged at predetermined intervals along Y- and X-axes so that said predetermined number (n−1) of nozzles define second to $n^{th}$ nozzle arrays extending parallel to said first nozzle array.

3. A nonwoven fabric making apparatus having X and Y axes perpendicular to each other, said apparatus comprising a plurality of nozzles adapted to eject streams of high pressure fluid against at least one surface of a fibrous web continuously traveling in a direction of said Y-axis to entangle component fibers of said web, said nozzles being arranged to form at least a first nozzle array inclined at a predetermined angle with respect to said Y-axis, said apparatus further comprising between each pair of adjacent nozzles of said first nozzle array, a predetermined number (n−1) of nozzles arranged at predetermined intervals along Y- and X-axes so that said predetermined number (n−1) of nozzles define second to $n^{th}$ nozzle arrays extending parallel to said first nozzle array, wherein said second to $n^{th}$ nozzle arrays are successively spaced from said first nozzle array and from one another and said predetermined number (n−1) of nozzles defining said second to $n^{th}$ nozzle arrays lie at positions bisecting a length between said pair of adjacent nozzles of said first nozzle array, wherein a declination angle $\alpha_2$ of said first to $n^{th}$ nozzle arrays with respect to said Y-axis is given by $$\alpha_2 = \tan^{-1}\frac{B(n-1)}{2A_2(n-1)/n} = \tan^{-1}\frac{nB}{2A_2}$$

where $\alpha_2$ is the declination angle of said nozzle arrays with respect to said Y-axis, $A_2$ is an actual distance between centers of said pair of adjacent nozzles in said first nozzle array, B is a spacing between adjacent said nozzle arrays, and n is the number of said nozzle arrays, and wherein, when centers of said nozzles of said first to $n^{th}$ nozzle arrays are projected onto said X-axis, adjacent projections of said centers are spaced by a projected distance P given by $$P = \frac{A_2}{n}\sin\alpha_2$$

wherein said projected distance P is in the range of from about 0.1 to about 0.25 mm.

* * * * *